United States Patent [19]

Moraly

[11] Patent Number: 4,667,746

[45] Date of Patent: May 26, 1987

[54] MOBILE APPARATUS FOR DRIVING DIFFERENT OBJECTS INTO THE GROUND BY IMPACT

[76] Inventor: Paul Moraly, 168, rue Victor Hugo, 93110 Rosny Sous Bois, France

[21] Appl. No.: 681,359

[22] Filed: Dec. 13, 1984

[30] Foreign Application Priority Data

Jan. 10, 1984 [FR] France ..... 84 00268

[51] Int. Cl.[4] ..... B25D 9/00

[52] U.S. Cl. ..... 173/89; 173/81; 173/39; 405/232

[58] Field of Search ..... 173/89, 81, 84, 86, 173/39, 42; 212/183, 184; 52/111, 121; 405/232

[56] References Cited

U.S. PATENT DOCUMENTS

| | | | |
|---|---|---|---|
| 2,501,369 | 3/1950 | Zavatkay | 173/86 |
| 2,659,583 | 11/1953 | Durkins | 173/86 X |
| 2,815,929 | 12/1957 | Andreatta | 173/89 X |
| 2,833,120 | 5/1958 | Barrett et al. | 173/89 |
| 2,904,320 | 9/1959 | Salisbury et al. | 173/39 X |
| 3,447,613 | 6/1969 | Lisenby | 173/86 |
| 3,490,548 | 1/1970 | Lake | 173/86 X |
| 3,601,342 | 8/1971 | Piasecki | 52/121 X |

FOREIGN PATENT DOCUMENTS

| | | | |
|---|---|---|---|
| 1577334 | 10/1980 | United Kingdom | 173/89 |

*Primary Examiner*—E. R. Kazenske
*Assistant Examiner*—Willmon Fridie, Jr.
*Attorney, Agent, or Firm*—William A. Drucker

[57] ABSTRACT

A mobile apparatus for driving different objects into the ground by impact, comprising a carrier structure supporting a swinging element along which slides a mass whose movements are controlled by a cable. The swinging element has a tubular structure divided longitudinally into two parts each comprising at least two surfaces for guiding two opposite zones of said mass so as to be able to provide alone longitudinal guiding of said mass and means for connecting these two parts together with free longitudinal sliding of one of the parts with respect to the other.

22 Claims, 13 Drawing Figures

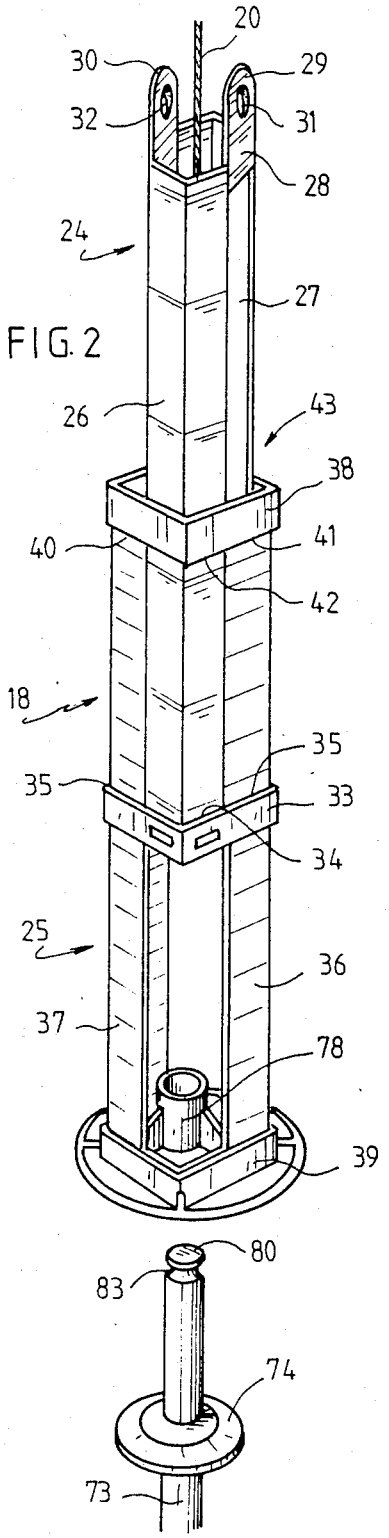
FIG. 2
FIG. 2a
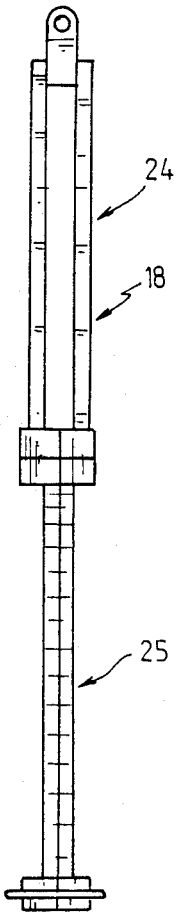
FIG. 2b
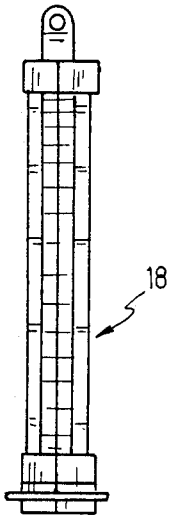
FIG. 2c
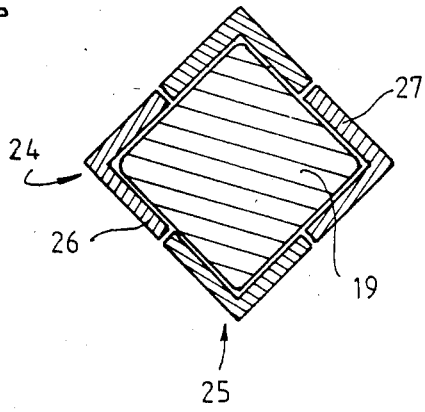

FIG. 4a
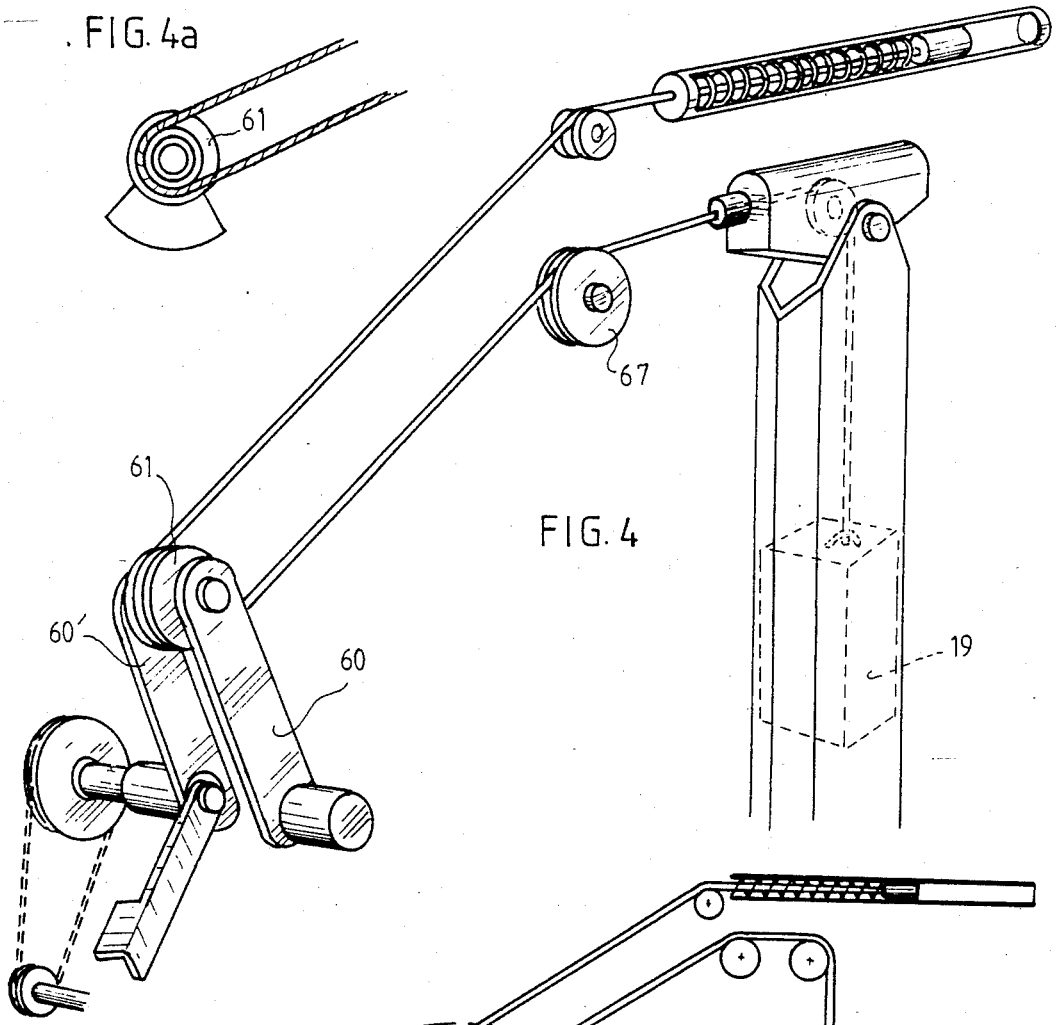
FIG. 4
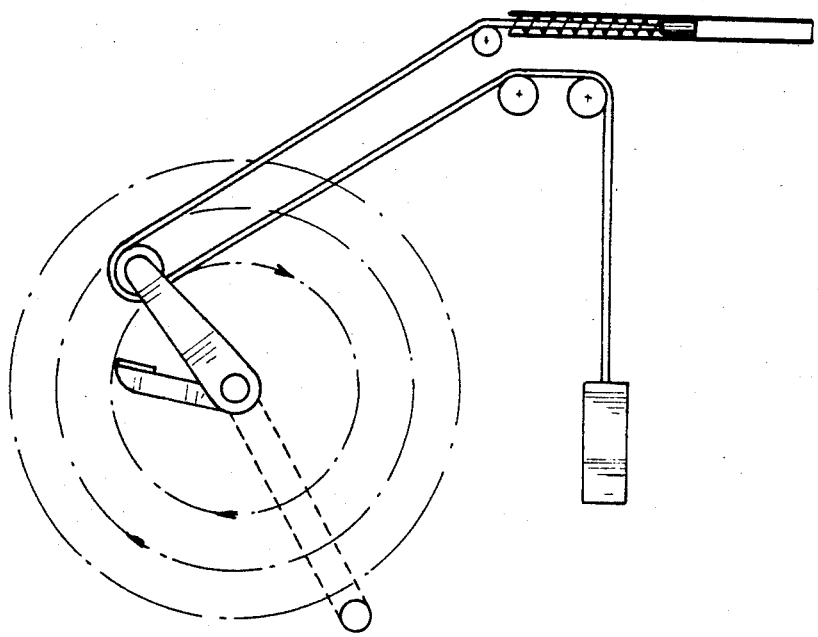
FIG. 4b

MOBILE APPARATUS FOR DRIVING DIFFERENT OBJECTS INTO THE GROUND BY IMPACT

BACKGROUND OF THE INVENTION

1. Field of the Invention

The present invention relates to a mobile apparatus for driving different objects into the ground by impact and, in particular, pegs for fixing posts or stakes.

It relates more particularly to an apparatus of the type comprising a carrier structure supporting a swinging element along which slides a mass whose movements are controlled by a cable connected to a driving device having a two stroke operating cycle, namely:

a first stroke during which the driving device raises the mass to the level of the upper part of the swinging element, and a second stroke during which the driving device interrupts its traction force and free wheels so as to let the mass drop under the effect of its own weight.

Thus, at the end of its fall, the mass may strike directly or indirectly the object which it is desired to drive into the ground and which has been previously disposed at right angles to the lower end of the swinging element.

2. Description of the Prior Art

It proves that the construction of an apparatus of this kind entails the resoltuion of numerous problems.

A first problem results from the fact that while the element is being driven in, the impact point of the mass moves downwards. Consequently, it is advisable to provide an arrangement for permanently adapting the travel of the mass and, consequently, guiding thereof to the driving-in level of the object to be driven in. It should be noted in this connection that a solution which may be considered for resolving this problem may consist in using a tubular shaped element whose inner surface serves for guiding the mass and for initially introducing, into the inner part of this tubular element, the object to be driven in. Thus, during driving in, the part of the object projecting outwardly from the ground remains inside the tubular element and is permanently guided in the volume of the passage of the mass.

However, this solution has the disadvantage of limiting the shape of the objects to be driven in, to the dimensions of the inner volume of the swinging element. Furthermore, it is subject to frequent jamming, because of deformation of the objects to be driven in, inside the swinging element, under the effects of the impacts in particular in the case of a hard ground.

The aim of the invention is therefore first of all to overcome these drawbacks. For this, it proposes a longitudinally extendable swinging element whose length is permanently adapted to the height of the object during driving in thereof, and which provides perfect continuity of guidance of the mass whatever this length may be.

SUMMARY OF THE INVENTION

According to one characteristic of the invention this swinging element comprises a tubular structure, divided longitudinally into two parts each having at least two surfaces for guiding two opposite zones of the mass so as to be able to provide alone longitudinal guiding of the mass, the guide surfaces of one of the parts being offset angularly with respect to those of the other part, and means for connecting these two parts together with free longitudinal sliding of one of the parts with respect to the other.

In a particularly advantageous embodiment of the invention, said swining element as well as said mass have a section in the shape of a quadrilateral. In this case, each of the two parts forming the tubular element comprises two parallel angle irons with mutually facing concavities. The opposite internal faces of these two angle irons are spaced apart by a length substantially equal to that of one side of said quadrilateral. Furthermore, the angle irons of each of these two parts are fixed to one another by their ends by means of two ficing devices one at least of which consists of a tubular piece with inner section in the form of a quadrilateral comprising internal walls which have two opposite angular regions against which the external faces of said angle irons are applied and fixed, and two angular guide regions.

The assembly of the two parts of the swinging element is then effected so that the angle irons of one of said parts pass through the tubular piece of the other part and are guided by the angular guide regions of this tubular piece and conversely.

According to another characteristic of the invention, the swinging element is connected, by its upper end, to the structure of the apparatus by means of a mechanical universal coupling integral with one of said parts so as to allow free swinging of the swinging element in two perpendicular directions.

Moreover, the lower end of the tubular element may comprise means for longitudinal guiding of a tool for driving in and guiding pegs with central sleeve for fixing posts or stakes into the ground and of a type similar to those described in U.S. Pat. No. 4,252,472 entitled: "Fixing posts in the ground", these guide means being provided so that the mass at the end of its travel impacts on the upper end of the driving tool.

In another embodiment of the invention, the mass may also comprise, fixed to its lower face, a pile shaped part substantially coaxial with the swinging element. This part may advantageously have a length slightly greater than that of said pin so as to permanently form a fore hole during driving-in of the peg. In this case, the lower end of the tubular element may comprise means for holding the head of the peg in position, these means equipping the lower end of the part of the tubular element which is not connected to said mechanical universal coupling.

Another problem which the invention solves relates to the formation of a kinematic chain for driving the mass and which is adapted to the above described swinging element.

Thus, according to another feature of the invention, driving of the mass inside the swing element is provided by means of a cable actuated by a driving device mounted on the structure of the apparatus and which passes, by means of a guide pulley system inside said mechanical universal coupling.

For this, the mechanical universal coupling may comprise a first fork substantially in the shape of a U, i.e. comprising a web from which extend two parallel arms. On the web of this fork is fixed a shaft which extends parallel to the two arms, in the longitudinal plane of symmetry of the fork and which comprises two parts projecting beyond the fork, on each side thereof. These two projecting parts are mounted for rotation in two respective bearings fixed to the structure of the apparatus.

Furthermore, the two arms of this first fork comprise:

on the one hand, two coaxial bores inside which is mounted the shaft of rotation of a pulley housed inside the fork which consequently follows the movements of the swinging element, and on the other hand, two coaxial journals fixed respectively to the outer faces of the two arms of the fork, the shaft of these two journals being situated at a distance from the shaft of rotation of the pulley, substantially equal to the radius of said pulley, and in a plane parallel to the web of the fork and passing through the axis of said pulley.

This mechanical universal coupling requires, at the upper part of the swinging element and integral with one of said parts, a fork structure comprising two parallel arms having two respective coaxial bores in which said journals are engaged.

It should further comprise at least one guide pulley mounted for rotation on the mobile structure of the apparatus so as to guide the cable to the inlet to the mechanical universal coupling.

According to another characteristic of the invention, the device for driving the cable is formed of a rotary arm mounted for pivoting by one of its ends on the structure of the apparatus and rotated by means of a motor, through a free wheel type transmission device. This rotary arm supports, at its other end, a pulley mounted freely rotatable about a shaft parallel to the shaft of rotation of said arm. In this device, the cable which is fixed by one of its ends to the mass, passes over the pulley of the mechanical universal coupling, is guided by the guide pulley, then passes around the pulley of said arm then comes back substantially parallel to itself and is fixed, by its other end, to a fixed point of the structure. The operation of this device will be more particularly described hereafter with reference to the drawings.

In a particularly advantageous embodiment of the invention, the mobile structure of the apparatus is mounted on three means for travelling over the ground disposed in a triangle and each equipped with a device for height adjustment of the structure.

BRIEF DESCRIPTION OF THE DRAWINGS

Preferred embodiments of the invention, will be described hereafter, by way of non limitative examples, with reference to the accompanying drawings in which:

FIG. 2 is a schematical perspective view of the swinging element used in the apparatus shown in FIG. 1;

FIG. 2*a*, 2*b* and 2*c* are views illustrating the principle of the swinging element shown in FIG. 2, this swinging element being in the opened-out position in FIG. 2*a* in the retracted position in FIG. 2*b* and in cross-section in FIG. 2*c*;

FIG. 4 is a schematical representation of the kinematic chain for driving the mass sliding in the swinging element shown in FIG. 2;

FIG. 4*a* shows a device for holding the cable on the traction pulley so as to prevent it from jumping off during the free fall of the mass;

FIG. 4*b* is a schematical section illustrating the operation of the kinematic chain of FIG. 4;

DESCRIPTION OF THE PREFERRED EMBODIMENTS

Figure 1:
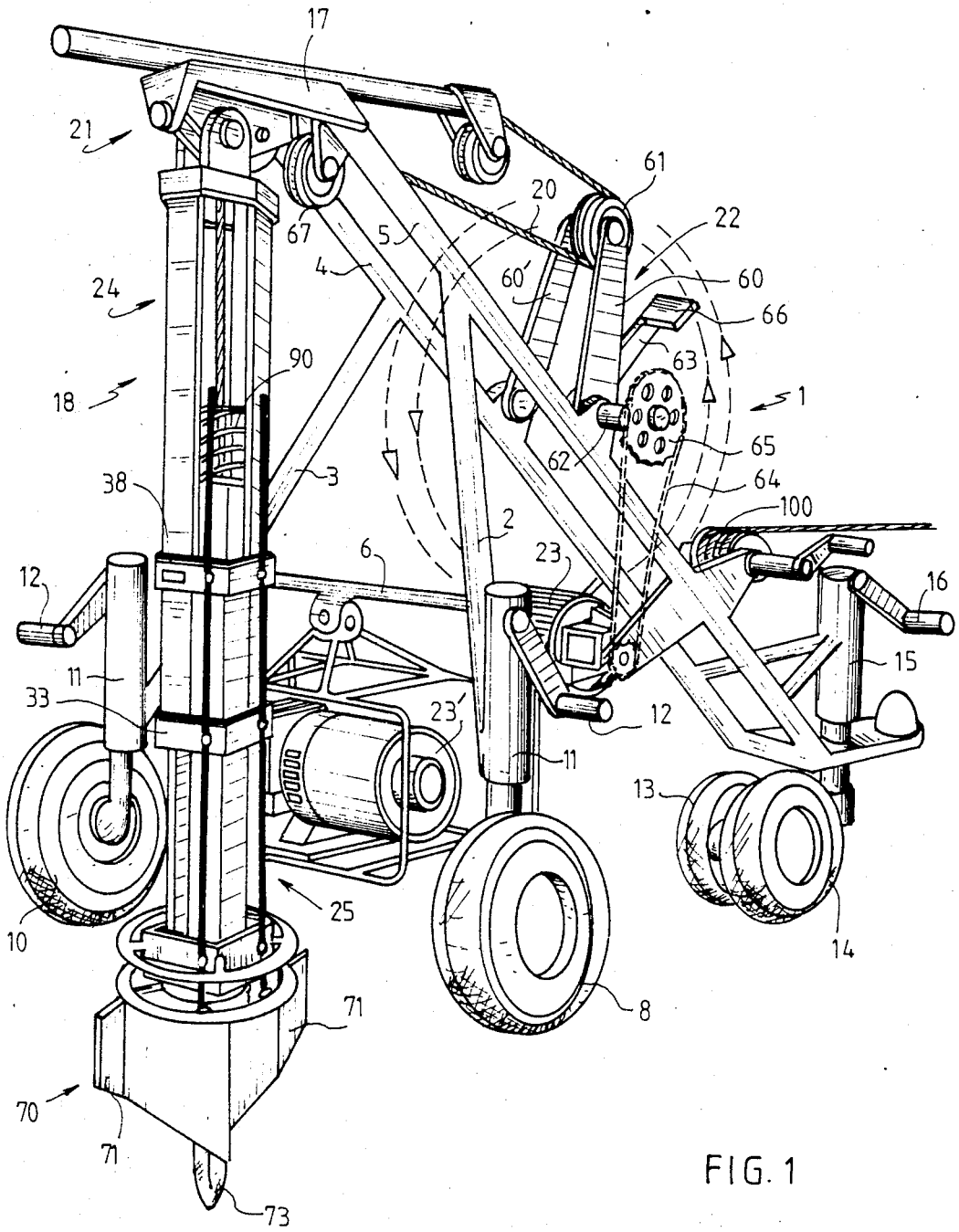
FIG. 1 is a schematical perspective view of an apparatus according to the invention in the electric version.

In the example shown in FIG. 1, the mobile apparatus for driving different objects into the ground such for example as stakes or posts or even pegs intended for fixing posts or stakes comprises first of all a tripod type carrier structure 1 whose feet extend along the edges of a pyramid shaped volume.

In this example, two of the feet of this structure each consist of an extruded section beam 2, 3 whereas the third foot is formed by two parallel beams 4, 5 slightly spaced apart from each other.

These three feet are connected together by means of cross pieces 6 only one of which is shown between beams 2 and 3.

At the lower ends of beams 2, 3 two parallel wheels 8, 10 are respectively mounted for pivoting by means of a connection device 11 allowing height adjustment of the foot by means of a crank handle 12. Similarly, at the lower end of the two parallel beams 4, 5 are mounted two paired wheels 13, 14 by means of a connecting device 15 allowing free orientation of the two wheels 13, 14 as well as height adjustment of the foot by means of the crank handle 16.

Figure 3:
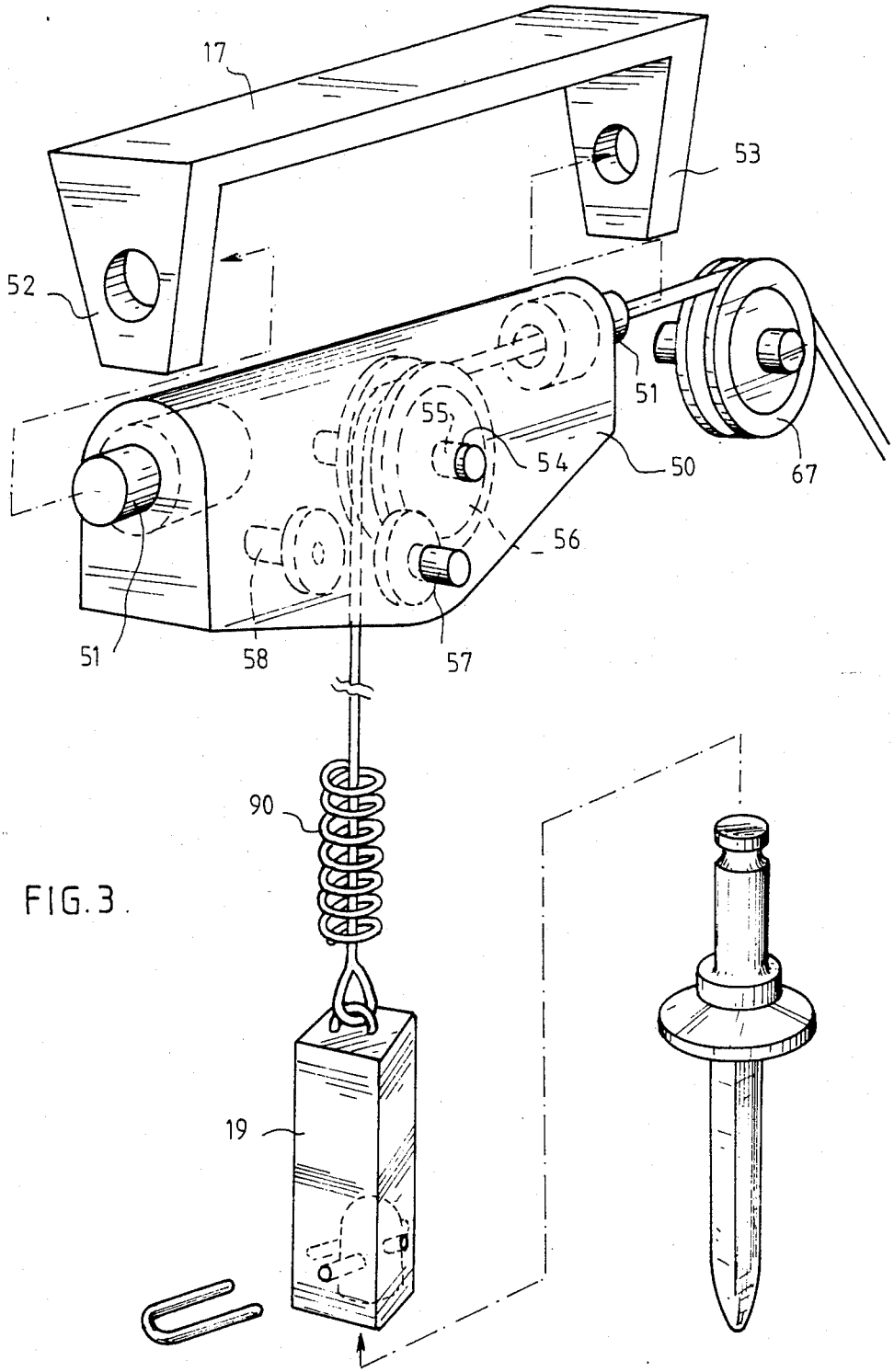
FIG. 3 is a schematical perspective view of the mechanical universal coupling device connecting the swinging element of FIG. 2 to the support structure of the apparatus of FIG. 1.

To the upper end of this tructure is fixed a plate 17 from the lower face of which is suspended, by means of a mechanical universal coupling of the type shown in FIG. 3, a swinging element 18 such as that shown in FIG. 2, inside which slides a mass 19.

This mass 19 is connected to a cable 20 which passes inside the tubular element 18 then in the mechanical universal coupling 21 then in a driving device 22 mounted on the two beams 4, 5 of the structure, the principle of which will be described in connection with FIG. 4.

This driving device 22 is itself driven by a motor driven—reducer unit supported by the two beams 4, 5. The motor of this unit may advantageously consist of an explosion engine. However, in the example shown, it is formed by an electric motor 23 supplied with power by a generating set 23' suspended by a universal coupling so as to keep a constant level of oil guaranteeing the long life of the set.

In the example shown in FIG. 2, the swinging element 18 in the retracted state as well as mass 19 have a square cross section. This swinging element 18 is formed by two longitudinal parts 24, 25 mounted for sliding one with respect to the other, namely:

a first part 24 comprising two parallel angle irons 26, 27, with mutual facing concavities disposed so as to guide the two opposite angular regions of the mass 19. These two angle irons 16, 27 are assembled together at their upper ends, by means of a connecting piece 28 comprising two parallel flanges 29, 30 pierced with coaxial bores 31, 32 so as to form a pivoting fork and, at their lower part, by means of a tubular square section piece 33, whose internal walls have two opposite angular regions 34 against which are applied and fixed the external faces of said angle irons 26, 27 and two angular guide regions 35, and a second part 25 comprising two parallel angle irons 36, 37, with mutually facing concavities and disposed so as to provide guiding of the other two opposite angular regions of mass 19; these two angle irons are assembled together at their upper and lower ends by two respective tubular square section elements 38, 39 whose internal walls have two opposite angular regions 40, 41 against which are applied and fixed the external faces of said angle irons 36, 37 and two angular guide regions 42, 43.

The two parts 24 and 25 of the tubular element 18 are assembled together so that the angle irons 26, 27 of part 24 pass through the tubular piece 38 of part 25 and are guided by the angular guide regions 42, 43 of this tubular piece and, conversely, the angle irons 36, 37 of part 25 pass through the tubular piece 33 of part 24 and are guided by the angular guide regions 35 of this tubular piece 33.

It is clear that when the swinging element 18 is in the extended state (FIG. 2*a*), in the top part, mass 19 is guided along a first diagonal by the two angle irons 26, 27 of the first part 24 and, in the low part, along the other diagonal by the two angle irons 36, 37 of the second part 25, so that mass 19 is suitably guided and without any discontinuity from one end to the other of the tubular element 18.

As mentioned above, mass 19 which drops freely in the swinging element is raised again by a cable 20 which passes through the mechanical universal coupling 21, so that it always remains in the longitudinal central axis of the swinging element 18.

For this, the mechanical universal coupling comprises first of all, as shown in FIG. 3, a pivoting fork 50 in the form of a U to the web of which are fixed two coaxial journals 51 extending in the longitudinal plane of symmetry of the fork. These two journals 51 are mounted in two respective bearings 52, 53 fixed to plate 17 situated at the upper part of the carrier structure 1.

The two arms of this fork 50 further comprise two coaxial bores 54 inside which is mounted the rotation shaft 55 of a pulley 56 housed inside fork 50 and two coaxial journals 57, 58 fixed respectively to the two outer faces of the two arms of fork 50.

The axis of these two journals 57, 58 is situated at a distance from the axis of rotation 55 of pulley 56 substantially equal to the radius of pulley 56 and in a plane parallel to the web of fork 50 passing through the axis of journals 57, 58.

These two journals 57, 58 are further engaged in the corresponding bores 31, 32 provided in the two flanges 29, 30 of the connecting piece 28 of the first part 24 of the tubular element 18.

With reference to FIG. 4, the device for driving cable 20 is formed from at least one arm 60 mounted for rotation by one end on one of the two parallel beams 4, 5 of the strucutre 1 of the apparatus and on which there is further mounted for rotation, at the other end, a pulley 61. This arm 60 is rotated by a motor driven reducer unit 23 through a free wheel transmission system. In the example shown, arm 60 is mounted freely rotatable on a shaft 62 on which is also rotatably mounted a second arm 63 rotated by the motor driven reducer unit 23 through a chain 64 and pinion 65 transmission (FIG. 1).

This second arm 63 comprises a stop 66 projecting into the passage volume of the first arm 60 so as to be able to rotate this latter in one direction.

In this device, cable 20 which is fixed by one of its ends to mass 19, passes over the pulley 56 of the mechanical universal coupling 21, is guided at the inlet of this connection by a guide pulley 67, then passes around pulley 61 of the first arm 60 then comes back parallel to itself and is secured to a fixed point P on the structure or is wound around a drum for adjusting the length of cable 20.

The operation of the above described apparatus is as follows:

With mass 19 at the bottom point of its travel inside the swinging element 18, the first arm 60 is in the top position and is rotated by the second arm 63, the resistant torque exerted by cable 20 on pulley 61 under the effect of mass 19 being exerted in a reverse direction to the direction of rotation exerted by arm 63. At the end of this half rotational travel, the direction of the resistant torque is reversed with respect to the direction of rotation of arm 63 and the first arm 60 is freed from stop 66 and is rotated by cable 20 at an angular speed greater than that of the second arm 63. Mass 19 then freely falls, strikes the driving tool or the peg situated at the end of the swinging element and is immobilized at the end of travel. A few moments later, the first arm 60 is again driven by the second arm 63 and a new cycle begins again.

Of course, the above described apparatus may advantageously comprise a device for maintaining cable 20 under a permanent tension. Such a device may use, in a conventional way, a tension spring between the fixed point and the cable as well as an abutment system. It could also consist of a counter weight mounted on cable 20 by means of a pulley-block.

Moreover, instead of using only a single arm 60, the device could possibly comprise, as shown in FIGS. 1 to 4, two arms 60, 60' mounted for rotation by one of their ends on the parallel beams 4, 5 and joined together at the other end by a pulley 61, the space between the two arms 60, 60' being freed so as to allow cable 20 to pass during rotation.

Furthermore, so that cable 20 does not jump from pulley 61 during the free fall of the mass, pulley 61 may be equipped, as shown in Fgiure 4a, with a holding device comprising two parallel lateral flanges mounted for rotation about the shaft of pulley 61 and extending on each side thereof. These two flanges are joined together by a massive piece forming a ballast which tends to bring the two flanges back to the vertical position.

As mentioned above, the apparatus of the invention may serve for anchoring in the ground pegs 70 comprising a rigid part formed advantageously from fin shaped metal plates 71, said rigid part forming a sleeve 72 for receiving the base of a poster or stake once the pegs 70 has been driven into the ground. It is known that these pins may be advantageously driven into the ground by means of a driving tool comprising a rigid elongate body 73 having at least, in its lower part, the shape of a false stake of a length slightly greater than that of the peg and, at the upper end of this false stake, a collar part 74 intended to retransmit a driving force to the upper face of the pegs.

Figure 5:
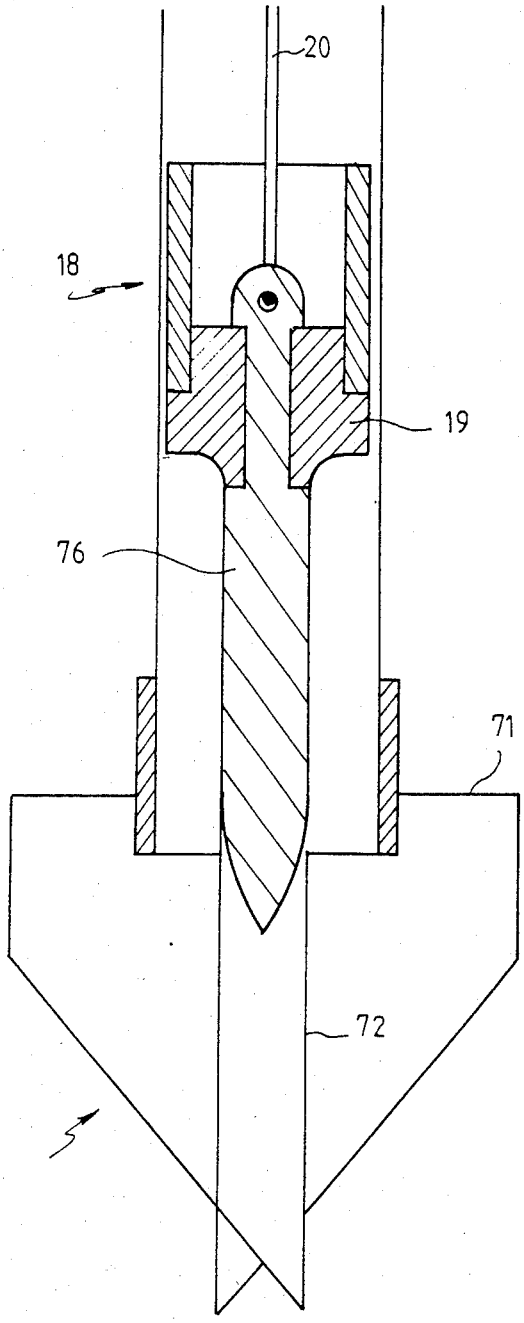
FIGS. 5 and 6 are two longitudinal sections of the lower end of the swinging element for illustrating two possible embodiments of the tool for driving in and guiding pegs with central sleeve.

Thus, in the example shown in FIG. 5, the driving tool is incorporated in mass 19 and consists simply of a false stake 76 mounted on the lower face of the mass.

In this case, the mass comes directly into contact with the upper face of the pegs and the swinging element 18 comprises at its lower part means for centering said pegs.

Figure 6:
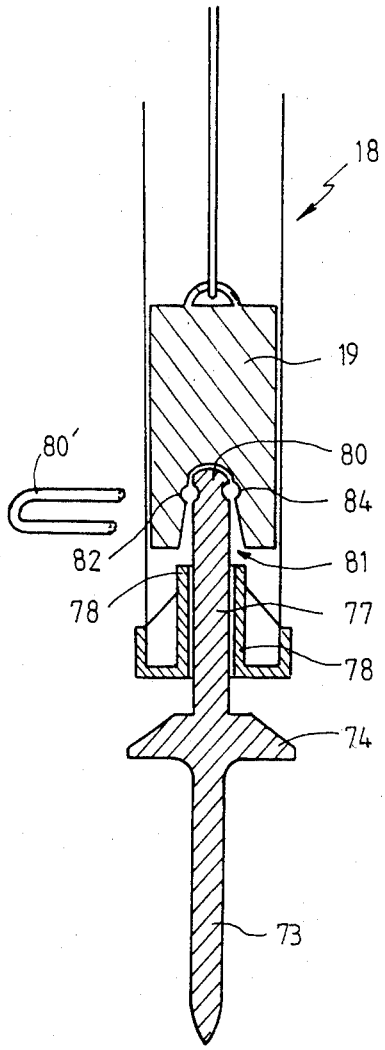

On the other hand, in the example shown in FIG. 6, the driving tool comprises, besides the false stake 73 and the collar part 74 for driving in the pins 70, a rod 77 mounted for axial sliding in a bearing 78 provided at the lower end of the swinging element 18 and the head of which is struck by mass 19.

It is obvious that the tool which slides in bearing 78 situated at the lower part of the swinging element is alone subjected to the impacts, thus preserving the assembly of the swinging element and of the apparatus. The swinging element then follows, with a slight delay due to its inertia, the drop of the tool.

In this case, head 80 of rod 77 may have a rounded shape and the lower face of mass 19 may comprise a central recess 81 in which is engaged said rounded shape of the head 80 of rod 77. This arrangement thus provides good centering of rod 77 during the impact of mass 19. Furthermore, means may be provided for locking head 80 of rod 77 to mass 19, so as to facilitate removal of the driving tool, once the peg 70 has been driven in. In the example showns, these fixing means consist of a U shaped peg or key 80' which engages in a groove 82, 84 formed in the head 80 of rod 77 and in recess 81. This arrangement consequently allows the bottom of the swinging element to be raised.

Because of the mechanical universal coupling 21, the swinging element 18 may be driven in any longitudinal and transverse direction so as to situate its longitudinal axis at will at a precise point while adjusting the height at each bearing point of the structure on the ground by means of crank handles 12, 16. These height adjustments allow more particularly:

1. The path of the swinging element to be corrected so as to arrive at a precise point, 2. To accomodate possible ground losses while leaving the apparatus vertical, 3. To adjust the apparatus by lowering or raising the whole of the assembly in order to take into account unevenesses in the ground.

As mentioned above, the apparatus may comprise for it straction, a winch 100 mounted on a shaft parallel to the shaft of wheels 8, 10, 19, 14 and suitably centered so as to obtain advance of the apparatus ina precise given direction even in very sloping or marshy zones.

This winch may be provided with a revolution counter for automatically calculating the distances between each driving operation carried out by the tool.

Figure 7:
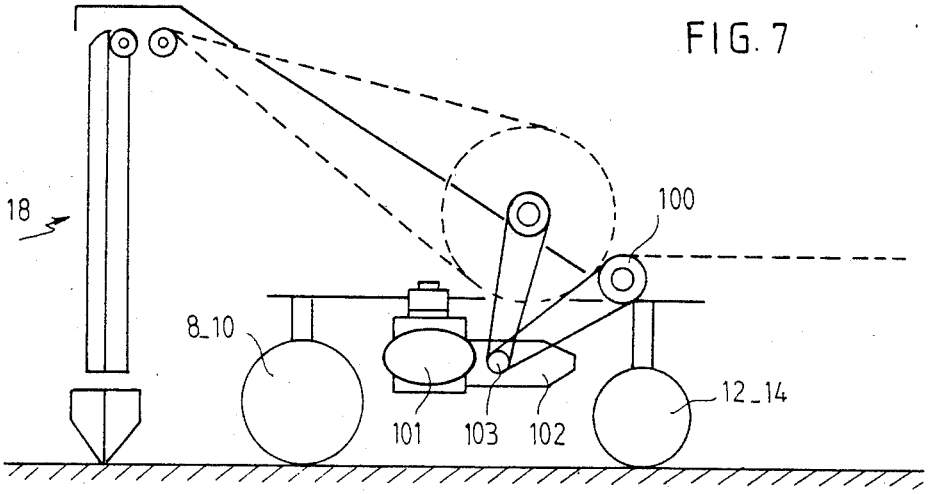
FIG. 7 is a theoretical diagram of one embodiment of an apparatus using an explosion engine.

In the embodiment of the invention shown in FIG. 7, the motor driven reducer unit 23 may consist of an explosion engine 101 with gear box 102, possibly automatic, differential 103 and centrifugal clutch. In this case, one of the sides of the differential may be coupled to said second arm 63 for raising the mass, the other side serving for actuating the winch. It is then sufficient to lock one of the sides of the differential so that the other is operational and to speed up or slow down the engine so as to start up the differential or stop everything. Moreover, it proves useful to provide safety contacts for the mass when it arrives at its top point just before its fall and on the swinging element 18 when it arrives at the end of its development travel, so as to avoid impacts of the mass on the swinging element.

Of course, travel of the mass may be increased inside the swinging element by acting on the height of the bearing points of structure 1 on the ground in the way described above. It is further possible to reduce the weight of mass 19 by placing a compression spring 90 in the swinging element 18 at a level corresponding to the top position of mass 19. The purpose of this spring 90 is then to project the mass 19 downwards and considerably increase the impact without having to modify the weight of mass 19.

To increase the safety of the apparatus, it may comprise safety grids surrounding the swinging element 18 and fixed to the tubular pieces 33, 38, so as to prevent any access to the empty spaces which are formed when the swinging element 18 is opened out.

Figure 8:
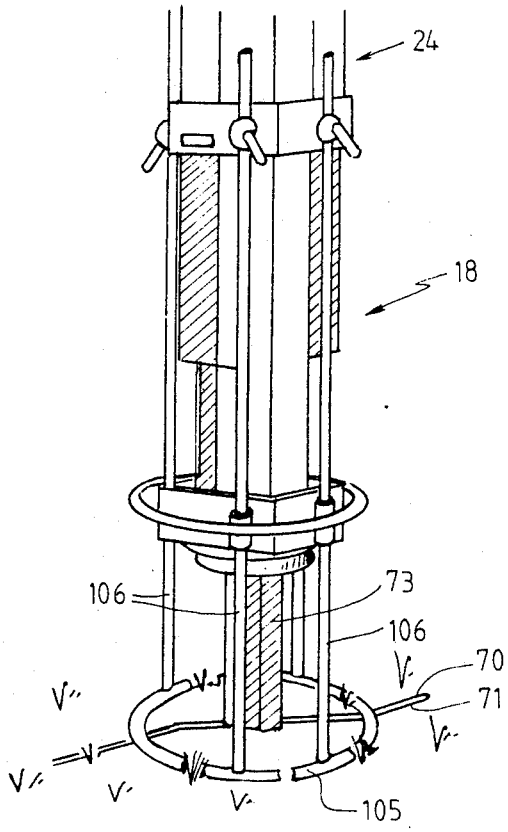
FIG. 8 shows in perspective the lower part of a swinging element equipped with a device for holding the driven-in peg on the ground during removal of the tool at the end of the operation.

With reference to FIG. 8, the device for maintaining the driven-in pin 70 on the ground, during removal of the tool, comprises a piece 105 for holding the peg on the ground, held in position by rods 106 mounted for sliding on the swinging element 18 and able to be locked for example by means of clamping screws to the upper part 24 of the swinging element 18.

What is claimed is:

1. In an apparatus for driving objects into the ground by ipact, said apparatus comprising a carrier structure supporting a swinging element along which slides a mass whose movements are controlled by a cable connected to a driving device having a two stroke operating cycle, said operating cycle including a first stroke during which the drive device acts on the cable for raising the mass to the level of the upper part of the tubular element and a second stroke during which the driving device interrupts its traction force on the cable and is free wheeling, so as to allow the mass to fall down under the effect of its own weight, said swinging element has a tubular structure longitudinally divided into first and second parts, each comprising at least first and second surface portions for respectively guiding first and second opposite surface portions of the mass, so as to be able alone to provide continuous longitudinal guiding of the mass along the first and second parts successively, the first and second guide surface portions of the first part being offset angularly with respect to the corresponding first and second guide surface portions of the second part, and means for connecting these first and second parts together with free longitudinal sliding of the second part with respect to the other wherein each of the two parts forming said tubular element comprise two parallel non-abutting angle irons, with mutually facing concavities.

2. The apparatus as claimed in claim 1, wherein said mass has a cross section in the shape of a first quadrilateral and the internal surface of said swinging element has a cross section in the form of a second quadrilateral having a shape which is substantially complementary to that said first quadrilateral,, wherein the angle irons of each of said two parts are fixed one to the other by their ends by means of two respective fixing devices one at least of which consists of a tubular piece with internal section in the form of a third quadrilateral comprising internal walls which have two opposite angular regions against which are applied and fixed the external faces of said angle irons and two angular guide regions, and wherein the assembly of the two parts of said swinging element is arranged so that the angle irons of one of said parts pass through the tubular piece of said other part and are guided by the angular guide regions of this tubular part, and conversely.

3. The apparatus as claimed in claim 1, wherein said swinging element is connected, by its upper end, to the structure of the apparatus by means of a mechanical universal coupling integral with one of said two parts.

4. The apparatus as claimed in claim 1, further comprising a cable tensioner.

5. The apparatus as claimed in claim 1, wherein the structure thereof is equipeed with three means for bearing on the ground disposed in a triangle and each equipped with a device for height adjustment of the structure.

6. The apparatus as claimed in claim 5, wherein said bearing means are equipped with means for rolling over the ground.

7. The apparatus as claimed in claim 1, further comprising a winch for providing movement thereof in a straight line.

8. The apparatus as claimed in claim 7, wherein said winch is equipped with a revolution counter.

9. The apparatus as claimed in claim 1, wherein the drive unit consists of an assembly comprising an explosion engine, clutch, a reducer and a differential, one of the sides of which is coupled to said device for driving the mass and the other side of which is coupled to said winch.

10. the apparatus as claimed in claim 1, wherein, in order to drive in pegs with a central sleeve, it comprises a driving tool comprising an elongate rigid body having, at least in its lower part, the shape of a false pile of a length slightly greater than that of the pegs and at the upper end of this false pile a collar part for retransmitting to the upper face of the pegs the driving-in force exerted by the mass.

11. The apparatus as claimed in claim 10, wherein said driving-in tool is integral with the lower face of said mass.

12. The apparatus as claimed in claim 10, wherein said driving-in tool comprises, beyond said collar part, a rod mounted for axial sliding in a bearing provided at the lower end of said swinging element and the head of which is struck by said mass.

13. The apparatus as claimed in claim 10, wherein said driving -in tool comprises, beyond said collar part, a rod mounted for axial sliding in a bearing provided at the lower end of said swinging element and the head of which is struck by said mass and the head of said rod has a rounded shape and the lower face of said mass comprises a central recess in which said rounded shape of the head of said rod may engage.

14. The apparatus as claimed in claim 10, wherein said driving-in toolc omprises, beyond said collar part, a rod mounted for axial sliding in a bearing provded at the lower end of said swinging element and the head of which is struck by said mass, said apparatus further comprising means for securing said rod to said mass.

15. The apparatus as claimed in claim 1, further comprising a compression spring mounted inside said swinging element at a level corresponding to the top position of said mass.

16. The apparatus as claimed in claim 1, further comprising a device for holding the driven-in peg on the ground, during removal of the tool, which comprises a bearing piece bearing on the peg and held in position by rods slidably mounted on said swinging element and fixed in the upper part thereof.

17. In an apparatus for driving objects into the ground by impact, said apparatus comprising a carrier structure supporting a swinging element along which slides a mass whose movements are controlled by a cable connected to a driving device having a two stroke operating cycle, said operating cycle including a first stroke during which the drive device acts on the cable for raising the mass to the level of the upper part of the tubular element and a second stroke during which the driving device interrupts its traction force on the cable and is free wheeling, so as to allow the mass to fall down under the effect of its own weight, said swinging element has a tubular structure longitudinally divided into first and second parts, each comprising at least first and second surface portions for respectively guiding first and second opposite surface portions of the mass, so as to be able alone to provide continuous longitudinal guiding of the mass along the first and second parts successively, the first and second guide surface portions of the first part being offset angularly with respect to the corresponding first and second guide surface portions of the second part, and means for connecting these first and second parts together with free longitudinal sliding of the second part with respect to the other; said swinging element is connected, by its upper end, to the structure of the apparatus by means of a mechanical universal coupling integral withone of said two parts; said mechanical universal coupling comprises a pivoting U shaped fork having two arms and a web to which is longitudinally fixed a shaft whose two ends are mounted for rotation in two respective bearings integral with the structure of the apparatus, wherein the two arms of said form comprise two coaxial bores inside which is mounted the shaft of rotation of a first pulley housed inside the fork, and two coaxial journals extending transversely outwardly of the fork which are engaged in two corresponding bores provided in two flanges forming a fork integral with the upper end of one of said two parts of said tubular element wherein each of the two parts forming said tubular element comprise two parallel non-abutting angle irons, with mutually facing concavities.

18. The apparatus as claimed in claim 17, wherein the axis of said journals is situated at a distance from the axis of rotation of said first pulley, substantially equal to the radius of said first pulley and in a plane parallel to the web of said fork passing through the axis of said first pulley.

19. The apparatus as claimed in claim 17, further comprising a second pulley for guiding the cable at the inlet to said mechanical universal coupling.

20. Apparatus as claimed in claim 19, wherein said cable driving device is formed form at least a first rotary arm mounted for pivoting, by one of its ends, on the structure of the apparatus and rotated by a drive unit through a free wheel type transmission device, this rotary arm supporting, at its other end, a thrid pulley mounted freely rotatable about an axis parallel to the axis of rotation of said arm and wherein the cable, which is fixed by one of its ends to the mass, passes over the said first pulley is guided by said second pulley, then passes around the third pulley arm, then comes back substantially parallel to itself and is fixed, by its other end, to a fixed point of said structure.

21. The apparatus as claimed in claim 20, wherein the connection of said cable to the structure of the apparatus is effected by means of a device allowing adjustment of the length of said cable and a means for maintaining said cable under tension.

22. The apparatus as claimed in claim 20, wherein the rotational driving of said first arm is provided by a second arm rotated by the drive unit, coaxially to the first arm, this second arm comprising a stop forming part extending in the passage volume of said first arm.

* * * * *